United States Patent [19]

Becker

[11] 4,135,583

[45] Jan. 23, 1979

[54] BULLDOZER BLADE

[76] Inventor: Clarence A. Becker, Box 249, Chase, B.C., Canada, V0X 2W0

[21] Appl. No.: 784,349

[22] Filed: Apr. 4, 1977

[51] Int. Cl.[2] ..... E02F 3/76

[52] U.S. Cl. ..... 172/802

[58] Field of Search ..... 172/802, 786, 804, 786; 37/50, 29, 34; 16/128 R

[56] References Cited

U.S. PATENT DOCUMENTS

| | | | |
|---|---|---|---|
| 2,051,428 | 8/1936 | Tatlow | 16/128 R |
| 2,428,131 | 9/1947 | Uebelhoer | 172/802 |
| 2,468,950 | 5/1949 | Wiedman | 172/802 |
| 3,157,099 | 11/1964 | Ulrich | 172/802 |
| 3,378,084 | 4/1968 | Ulrich | 172/802 |
| 3,512,589 | 5/1970 | Ulrich | 172/786 |
| 3,823,783 | 7/1974 | Luedtke | 172/802 |

*Primary Examiner*—Richard J. Johnson

*Attorney, Agent, or Firm*—Graybeal, Barnard & Uhlir

[57] ABSTRACT

A blade for a bulldozer. The blade comprises a post of variable, substantially circular cross section varying from a maximum at the top and the bottom uniformly to a minimum at the middle. The post is attachable to a bulldozer. A blade member is pivotally mounted to each side of the post. Each blade member is shaped at its inner end to correspond to the shape of the surface of the post. The blade is adapted to attach to, for example, hydraulic rams to pivot each blade member independently about the post. Thus, upon pivoting, each blade moves around the post while at least maintaining a uniform, small distance from said post.

10 Claims, 6 Drawing Figures

5
18
36
56
38
40
48
54
60
14
2
34
16
12
20

34
2
4
26
28
32
30
16
3
10
8
6
12

18
26
32
12
2
10
34
6
4
16
20

BULLDOZER BLADE

FIELD OF INVENTION

This invention relates to a bulldozer blade.

DESCRIPTION OF PRIOR ART

It is often desirable to have a bulldozer blade that is able to assume a variety of positions. Blades are known that are straight in section. Other blades are V-shaped with the apex of the V either leading or trailing. It is clearly desirable to have a blade for a bulldozer that is able to assume a variety of positions but this has not previously been possible. Although it is known to angle the straight blade, by moving one end of the blade further from the bulldozer than the other end, there has not been any successful attempt to provide a blade able to assume a variety of positions. The normal procedure is to change the blade. A principal difficulty has been to develop a system that is free of jamming around a joint. Blades are known to be made up of two blade members but normally the point at which the blade members join presents problems in that rocks can enter to jam the blade or damage it. As a result blades in which the angle of the components that make up the blade can be varied have been restricted to relatively light blades useful on, for example, trucks and, even there, a blade has not been developed that is able to form a V in which the apex trails—usually called a U-blade—as well as a V in which the apex leads—usually referred to as a V-blade.

SUMMARY OF INVENTION

The present invention seeks to provide a blade for a bulldozer in which each of the blade members that make up the blade can be pivoted around a central post independently of the position of the other blade member.

Thus, in a first aspect, the present invention is a blade for a bulldozer comprising a post of variable, substantially circular cross section varying from a maximum at the top and the bottom uniformly to a minimum at the middle; means to permit attachment of said post to a bulldozer; a blade member pivotally mounted on each side of the post, each blade member being shaped at its inner end to correspond to the shape of the surface of the post; and means to pivot each blade member independently about the post whereby, upon pivoting, each blade moves around the post while at least maintaining a uniform, small distance from said post. It may be desirable to have the blade members in constant contact with the post.

In a preferred aspect the means to pivot each blade member independently is a hydraulic ram that has a piston in the cylinder and a hollow rod attached to the piston and extending from the cylinder to an attachment to the bulldozer. A protective sleeve for the rod is attached at a first end of the hollow rod and fits slidably over the cylinder. Hydraulic supply lines extend through the rod, a first hydraulic supply line to one side of the piston and a second hydraulic supply line to a second side of the piston. The rod and thus the hydraulic lines are protected from rocks and the like by the sleeve.

BRIEF DESCRIPTION OF DRAWINGS

The invention is illustrated, by way of example in the accompanying drawings in which.

DESCRIPTION OF PREFERRED EMBODIMENT

Figure 4:
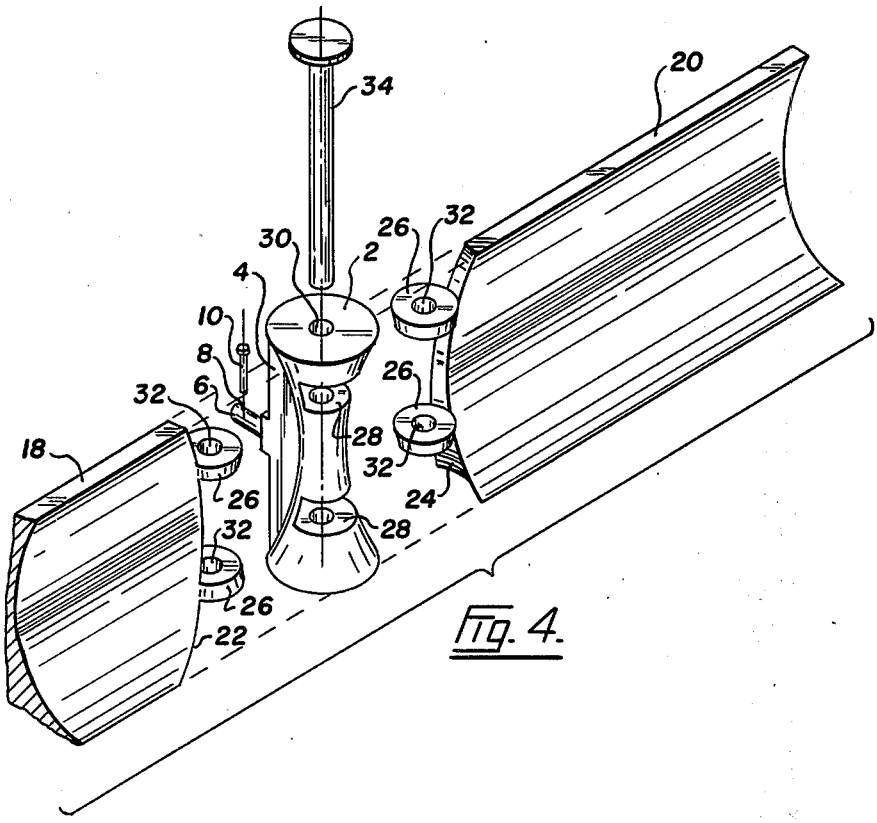
FIG. 4 is an exploded view, partially cut away, of a blade according to the invention.

The drawings illustrate a blade for a bulldozer, the blade itself being shown most clearly in FIG. 4. The blade comprises a post 2 of a variable substantially circular cross section. The cross section varies from a maximum at the top and bottom of the post 2 to a minimum at the middle. The post has a reinforcement 4 on its back surface and there is a rod 6 attached to the reinforcement 4. A hole 8 in the rod 6 receives a pin 10 to enable location of the post 2 to a conventional C-frame 12 of a bulldozer 14 shown in outline in FIG. 1. The C-frame may be modified, if necessary, to provide a reinforced hole through its leading edge 16 to receive the rod 6. The reinforcement 4 together with the rods 6, hole 8 and pin 10 thus provide a means to permit attachment of the post to a bulldozer 14.

Figure 2:
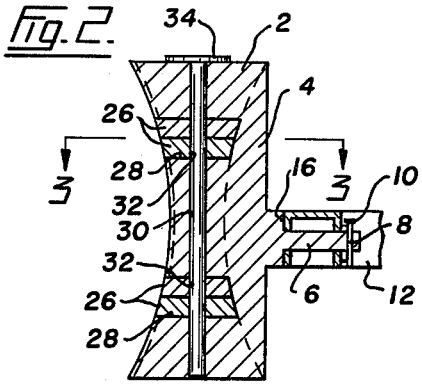
FIG. 2 is a section on the line 2—2 in FIG. 1.
Figure 3:
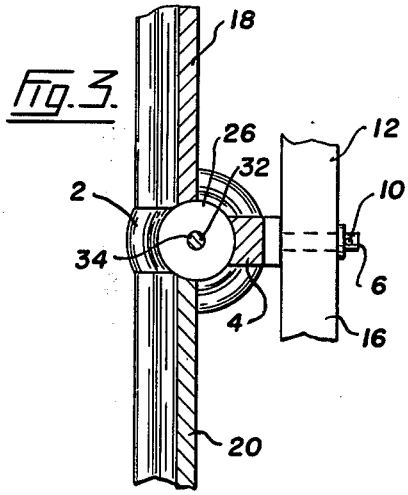
FIG. 3 is a section on the line 3—3 in FIG. 2.

Blade members 18 and 20 are pivotally mounted to each side of the post 2. Each blade member 18 and 20 is shaped at its inner ends 22 and 24 respectively, to correspond to the shape of the surface of the post 2. In the illustrated embodiment each blade member 18 and 20 is pivotally attached to the post 2 by spaced circular flanges 26, each shaped to correspond to the cross section of the post 2 at a predetermined position. There are two recesses 28 in the post 2, each recess to receive two flanges 26, one from each blade member 18 and 20 as illustrated particularly in FIGS. 2 and 4. There is an axial longitudinal channel 30 in the post 2. There are axial channels 32 in the flanges 26 that align with the axial longitudinal channel 30 in the post 2 when the blade members 18 and 20 are attached to the post. A shaft 34 inserted through said channels 30 and 32 provides a pivotal mounting for the flanges 26, and thus the blade members 18 and 20.

Figure 5:
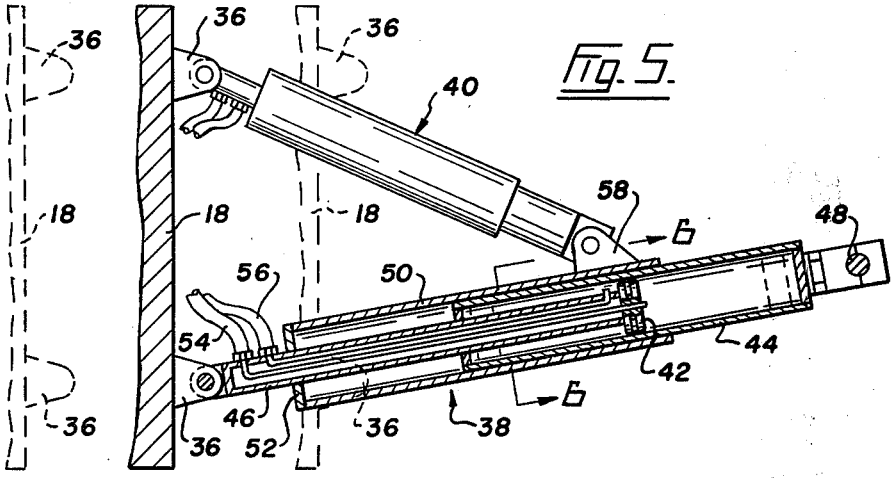
FIG. 5 illustrates the mounting of the blade according to the present invention.
Figure 6:
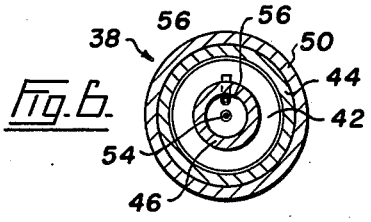
FIG. 6 is a section on the line 6—6 in FIG. 5.

Each blade member 18 and 20 is provided with brackets 36 to enable attachment to hydraulic rams—see FIG. 5. In the illustrated embodiment four hydraulic rams are used, two first or lower rams 38 and two second or higher rams 40. The positioning of these rams is best illustrated in FIG. 5 although it should be remembered that there are two rams to each blade member 18 and 20 as shown in FIG. 1.

The rams are attached to the brackets 36 and to the C frame 12 in a manner conventional for the attachment of rams and bracing members between the blades and the C-frames of bulldozers. Ram 38 is shown in section in FIG. 5. However, all the rams 38 and 40 useful in the attachment of the blade according to the present invention are desirably of the configuration of ram 38 shown in FIG. 5. Ram 38 has a piston 42 in a cylinder 44. A hollow rod 46 is attached to the piston 42 and extends from the cylinder to a conventional pivotal attachment 48 to the C-frame 12. The rod 46 is provided with a protective sleeve 50 attached at a first end 52 to the hollow rod 46 and, at its other end, fitting slidably over the cylinder 44. Hydraulic supply lines extend through the hollow rod 46. A first hydraulic supply line 54 leads to the upper side of the piston 42. A second hydraulic supply line 56 supplies hydraulic fluid to the lower side of the piston 42. Thus, by applying hydraulic fluid through line 54 the ram is extended. By applying hydraulic fluid to line 56 the ram is retracted. The sleeve 50 provides protection for the rod 46 and thus, indirectly, for the hydraulic supply lines 54 and 56 as they are within rod 46. The conventional, prior art system is to feed hydraulic fluid direct to connectors at the exterior of the cylinder 44, one connector at each end of the cylinder 44. However, the disadvantage of that system is that the supply lines are then vulnerable to, for example, rocks that may move over the top of the blade and fall onto the supply lines. Similarly the rod 46 can be bent and rendered inoperable by such rocks.

As illustrated in FIG. 5 the second hydraulic ram 40 is pivotally attached to a bracket 58 on the exterior of the sleeve 50. This simplifies the mounting of the hydraulic rams 38 and 40. There can be an independent hydraulic source to the rams 38 and 40 to permit tipping of the blade. It is highly desirable that there be independent hydraulic supply lines to the pairs of rams 38 and 40 attached to each blade member 18 and 20 so that the blade members 18 and 20 may be moved independently of each other.

Figure 1:
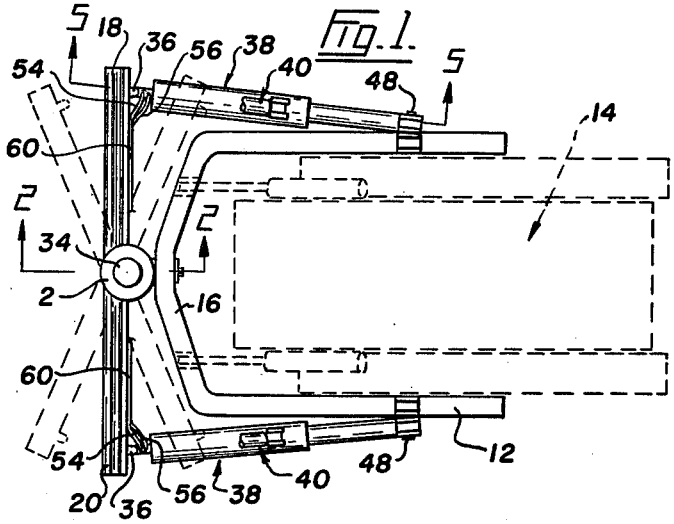
FIG. 1 is a plan view of a bulldozer fitted with a blade according to the present invention.

Hydraulic fluid is supplied to the line 54 and 56 by supply lines 60 attached to the backs of the blade members 18 and 20 as shown in FIG. 1.

The illustrated blade according to the present invention has a wide variety of uses. It will be appreciated that by independent operation of the rams 38 and 40 the blade members 18 and 20 can be moved, independently, to any angle permitted by the movement of the rams. That is by extending all the hydraulic rams 38 and 40 the blade members 18 and 20 form a U-blade. By retracting all the hydraulic rams 38 and 40 the blade members 18 and 20 form a V-blade. At an intermediate position for the rams the blade resembles a conventional straight blade. Similarly by partially withdrawing the rams on one side of the machine and extending the rams on the other a straight blade can be formed that is angled to the direction of travel. It is also possible to move the hydraulic rams 38 and 40 so that one blade member 18 or 20 is normal to the direction of travel of the bulldozer 14 while the other blade member 18 or 20 leads or trails.

It should be emphasized that the hydraulic rams may be replaced by pairs of co-operating members, one member of each pair internally threaded and the other member externally threaded. This system is well-known in the art but lacks the ease of control of hydraulic systems as manual adjustment of the threaded, co-operating members is required.

The particular configuration of the post 2 means that all these wide variations in the positions of the blade members 18 and 20 can be carried out without risk of jamming, for example by rocks, between the inner ends of the blade members 18 and 20 and the post 2.

The blade according to the present invention may be made of the materials conventional for the production of bulldozer blades.

I claim:

1. A blade for a bulldozer comprising a post of variable, substantially circular cross section varying from a maximum at the top and the bottom uniformly to a minimum at the middle;

means to permit attachment of said post to a bulldozer;

a blade member pivotally mounted to each side of the post, each blade member being shaped at its inner end to correspond to the shape of the surface of the post;

the blade being adapted to attach to means to pivot each blade member independently about the post whereby, upon pivoting, each blade moves around the post while at least maintaining a uniform, small distance from said post.

2. A blade as claimed in claim 1 in which the means to permit attachment of the post to a bulldozer is a pin rearwardly extending from the post and adapted to be locked into an opening in a C-frame attached to the bulldozer.

3. A blade as claimed in claim 2 in which the post is reinforced at that portion of its circumference adjacent the bulldozer and in which the pin extends rearwardly from the rear of the reinforcement.

4. A blade as claimed in claim 1 in which each blade member is pivotally attached to the post by a flange extending from the inner edge of said blade;

a recess in the post to receive each flange from each blade.

5. A blade as claimed in claim 4 in which there are two spaced, circular flanges on each blade, each shaped to correspond to the cross section of said post;

two recesses in the post, each recess to receive two flanges, one from each blade;

an axial longitudinal channel in said post;

axial channels in said flanges to align with said axial longitudinal channel when the blades members are attached to the post; and a shaft extending through said channels to permit the flanges, and thus the blades, to pivot.

6. A blade as claimed in claim 1 in which the means to pivot each blade member is a hydraulic ram attachable at one end to the bulldozer and at its other end to a blade member.

7. A blade as claimed in claim 6 in which the hydraulic rams are attached to the C-frame of the bulldozer.

8. A blade as claimed in claim 6 including two hydraulic rams for each blade member.

9. A blade as claimed in claim 6 in which each hydraulic ram has a piston in a cylinder and a hollow rod attached to said piston and extending from said cylinder to said attachment to the bulldozer;

a protective sleeve for the rod attached at its first end to the hollow rod and fitting slidably over the cylinder;

hydraulic supply lines entering said hollow rod adjacent blade members and extending through said rod, a first hydraulic supply line to one side of said piston and a second hydraulic supply line to a second side of said piston.

10. A blade as claimed in claim 9 in which there are two hydraulic rams to each blade member, the second hydraulic ram to each blade member being attached at its end remote from the blade to the sleeve of the first ram and the first ram being attached to the C-frame of the bulldozer.

* * * * *